US006154931A

United States Patent [19]

Corrales

[11] Patent Number: 6,154,931

[45] Date of Patent: Dec. 5, 2000

[54] DEVICE FOR LOADING THE UPPER DRAWING ROLLS IN A DRAW FRAME AND METHOD

[75] Inventor: Pedro Corrales, Mönchengladbach, Germany

[73] Assignee: Trützschler GmbH & Co. KG, Mönchengladbach, Germany

[21] Appl. No.: 09/373,563

[22] Filed: Aug. 13, 1999

[30] Foreign Application Priority Data

Sep. 2, 1998 [DE] Germany ..... 198 39 885

[51] Int. Cl.[7] ..... D01H 5/46

[52] U.S. Cl. ..... 19/267; 19/260; 19/266

[58] Field of Search ..... 19/236, 239, 258, 19/260, 261, 266, 267, 271, 272, 273, 278, 294, 295

[56] References Cited

U.S. PATENT DOCUMENTS

| | | | |
|---|---|---|---|
| 2,890,495 | 6/1959 | Miesch et al. | 19/258 |
| 3,079,648 | 3/1963 | Schiltknecht | 19/267 |
| 3,200,446 | 8/1965 | Dausch | 19/295 |
| 3,310,847 | 3/1967 | Aurich | 19/261 |
| 4,510,648 | 4/1985 | Mori et al. . | |
| 5,477,591 | 12/1995 | Morell | 19/294 |
| 5,613,280 | 3/1997 | Mandl | 19/239 |
| 5,761,772 | 6/1998 | Clapp et al. . | |
| 5,799,374 | 9/1998 | Strobel et al. | 19/267 |
| 5,953,793 | 9/1999 | Roder | 19/266 |

FOREIGN PATENT DOCUMENTS

| | | |
|---|---|---|
| 0 475 530 | 3/1992 | European Pat. Off. . |
| 197 04 815 | 8/1998 | Germany . |
| 2 154 619 | 9/1985 | United Kingdom . |
| 2 205 112 | 11/1988 | United Kingdom . |

*Primary Examiner*—Michael A. Neas
*Assistant Examiner*—Gary L. Welch
*Attorney, Agent, or Firm*—Venable; Gabor J. Kelemen

[57] ABSTRACT

A method of operating a draw frame including a plurality of serially arranged roll pairs each defining a nip through which a fiber sliver passes from roll pair to roll pair. Each roll pair is formed of an upper roll and a lower roll. A pressing arm carries the upper rolls, and pressing devices are accommodated in the pressing arm for pressing each upper roll against a respective lower roll. The method comprises the following steps: during the working state of the draw frame, passing the sliver consecutively through the roll pair nips while the pressing devices press the upper rolls against respective lower rolls, and during an interruption of the working state the upper output roll is relieved of pressing forces to an extent that at the most only an insubstantial pressure is exerted by the upper output roll on the sliver situated in the nip between the upper output roll and the lower output roll.

8 Claims, 6 Drawing Sheets

DEVICE FOR LOADING THE UPPER DRAWING ROLLS IN A DRAW FRAME AND METHOD

CROSS REFERENCE TO RELATED APPLICATION

This application claims the priority of German Application No. 198 39 885.9 filed Sep. 2, 1998, which is incorporated herein by reference.

BACKGROUND OF THE INVENTION

This invention pertains to a draw frame for textile slivers and is more particularly directed to a method and a device for pressing down the upper rolls onto the respective lower rolls of the drawing unit which is composed of serially arranged roll pairs formed of upper and lower rolls. During operation the upper rolls are pressed against the respective lower rolls by loaded pressing elements in pressing arms. In the inoperative state the upper rolls are relieved of pressure by the pressing arms.

During operation, the pressing arms are closed and the pressing devices press the upper rolls onto the associated lower rolls of the drawing unit. In case the drawing frame is at a standstill particularly for a longer time period, the pressing arms are opened to thus release the upper rolls from the pressing forces for protecting the roundness of the rolls and their elastic coating against deformation. In a known arrangement the pressing arms are pivoted open manually while the upper rolls remain stationarily positioned on the lower rolls. In such an arrangement the upper rolls exert a pressure on the lower rolls by their weight. Since the slivers are positioned between the upper and lower rolls, the upper rolls, in their idle state, exert a pressure on the slivers. During operation, particularly at high sliver speeds of 1,000 m/min and above, the rolls heat up substantially. Frequently the fibers contain substances which become sticky when heated, for example, honeydew in cotton and reviving agents in chemical fibers. Occasionally the draw frame is at a standstill for a period which is longer than, for example, the time required for coiler can replacements at the output end of the draw frame. Such longer periods may occur, for example, in case of sliver rupture or in case of coiler can replacements at the input end of the draw frame, during operational disturbances and the like. During such longer standstill periods, particularly as the upper output roll (or rolls) press against the sliver situated between the roll pair the earlier noted substances become sticky by heating. As a disadvantageous result, the slivers adhere firmly mostly to the upper rolls and, when operation resumes, the slivers are entrained in a circular path by the rotating roll and are thus wound thereon. This is a highly undesirable phenomenon which results in substantial operational disturbances since the draw frame must be immediately stopped and the wound sliver manually removed from the roll. Such a defect may often not be immediately eliminated which leads to significant delays and thus to downtimes in the production.

SUMMARY OF THE INVENTION

It is an object of the invention to provide an improved method and apparatus of the above-outlined type which avoid the above-discussed disadvantages and by means of which an undesired winding of the sliver around the drawing rolls is eliminated or significantly reduced in a simple manner.

This object and others to become apparent as the specification progresses, are accomplished by the invention, according to which, briefly stated, the method is performed on a draw frame which includes a plurality of serially arranged roll pairs each defining a nip through which a fiber sliver passes from roll pair to roll pair. Each roll pair is formed of an upper roll and a lower roll. A pressing arm carries the upper rolls and pressing devices are accommodated in the pressing arm for pressing each upper roll against a respective lower roll. The method comprises the following steps: during the working state of the draw frame, passing the sliver consecutively through the roll pair nips while the pressing devices press the upper rolls against respective lower rolls, and during an interruption of the working state the upper output roll is relieved of pressing forces to an extent that at the most only an insubstantial pressure is exerted by the upper output roll on the sliver situated in the nip between the upper output roll and the lower output roll.

By providing that the pressure of the upper rolls is absent and, in particular that the upper roll is only slightly contacting the fiber material or is in no contact with it at all, a heating of the potentially sticky substances in the fiber material and thus an adhesive effect are avoided. As a result, the slivers are prevented from adhering to the rolls and therefore the disadvantageous winding of the fiber material about the rolls upon restarting of the draw frame operation will not take place.

The invention has the following additional advantageous features:

- The relief of pressure exerted by the upper roll is effected automatically.
- Upon resumption of operation, the pressure exerted by the upper roll is re-applied automatically.
- In a drawing frame having a 4-over-3 drawing unit the upper roll closest to the outlet of the drawing unit may be relieved of pressure.
- The upper roll is a deflecting roll.
- The relief of pressure by the upper roll is effected by lifting at least one upper output roll off the respective lower roll.
- A clearance between the upper output roll or the upper output rolls and the slivers is provided when the pressure exerted by the upper roll or upper rolls is relieved.
- In an apparatus in which the upper rolls are pneumatically loaded, a separately controllable pneumatic valve is provided for the pneumatic cylinder for lifting the upper output roll or rolls.
- The pneumatic cylinder is associated with a settable carrier lever for the upper output roll.
- The relief of the pressure exerted by the upper roll output is effected by a magnet or a controllable electromagnet.
- Upon stoppage of the drawing frame at least one roll is automatically disengaged from the fiber material.
- The last upper roll, as viewed in the direction of material advance, may be moved automatically out of contact with the sliver and, upon resumption of the operation, such lifted roll is automatically again brought into pressure contact with the fiber material.

DESCRIPTION OF THE PREFERRED EMBODIMENTS

Figure 1:
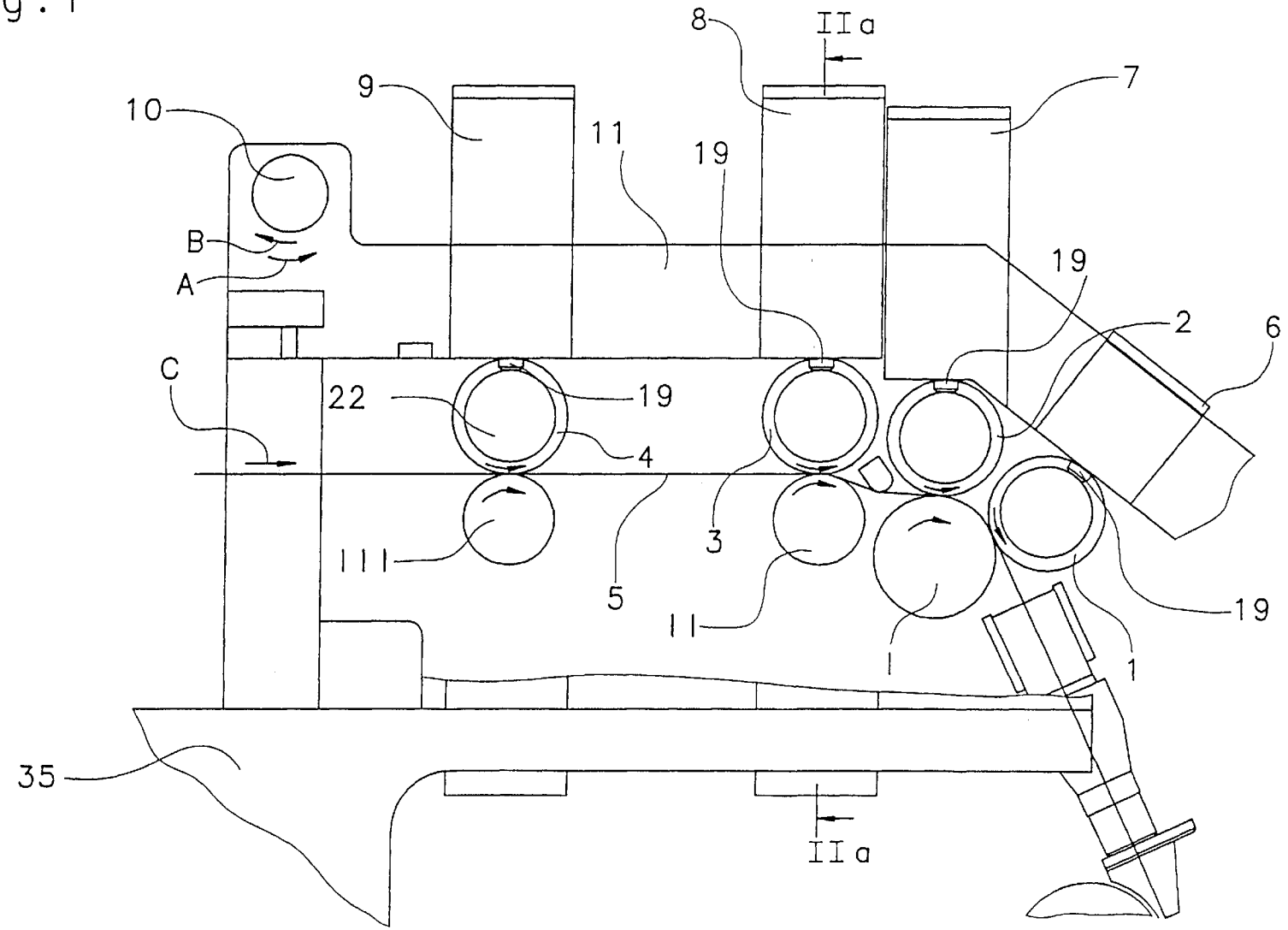
FIG. 1 is a side elevational view of a drawing unit incorporating the invention.

FIG. 1 shows a drawing unit forming part, for example, of an HS-model drawing frame manufactured by Trützschler GmbH & Co. KG, Mönchengladbach, Germany. The drawing unit is of the "4-over-3" type, that is, it is formed of three lower rolls I (lower output roll), II (lower middle roll) and III (lower input roll) and four upper rolls 1, 2, 3 and 4. With the lower output roll I two pressure-relievable upper output rolls 1 and 2 are associated. The last upper output roll 1—as viewed in the direction of sliver run C—operates as a deflecting roll. The drawing unit drafts the sliver bundle 5 formed of a plurality of slivers and advancing through the drawing unit in the direction of the arrow C. The roll pairs formed of rolls 4 and III as well as 3 and II constitute a pre-drafting field while the roll pair formed of rolls 3 and II and the roll assembly formed of rolls 1, 2 and I constitute the principal drawing field.

The lower output roll I is driven by a non-illustrated principal motor which determines the output speed. The lower input roll III and the lower middle roll II are driven by a non-illustrated regulating motor. The upper rolls 1–4 are pressed against the respective lower rolls I, II, III by pressing devices 6, 7, 8 and 9 positioned in pressing arms 11 (only one is visible) rotatable in the direction of arrows A and B about a bearing 10. The upper rolls 1–4 are driven by the respective lower rolls I, II and III by frictional contact.

Figure 2A:
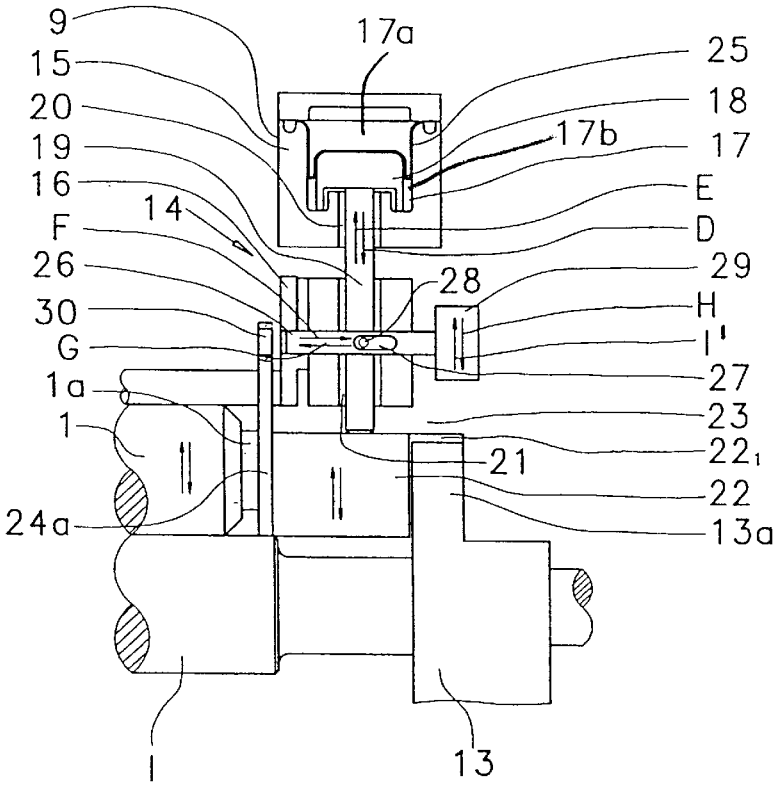
FIG. 2*a* is a sectional view taken along line IIa—IIa of FIG. 1.
Figure 2B:
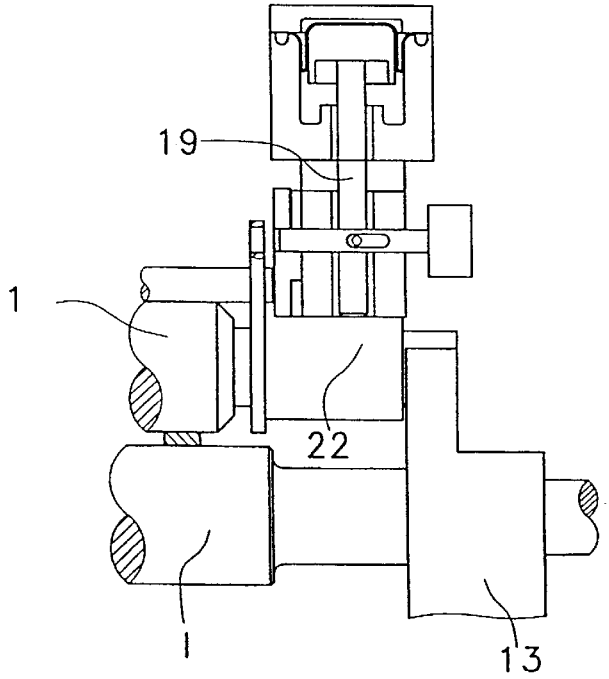
FIG. 2*b* is a view similar to FIG. 2*a,* showing the upper roll in a raised position.

Also referring to FIGS. 2*a* and 2*b*, the lower rolls I, II and III are supported in bearing blocks 13 mounted on the machine frame 35. The pressing arms 11 also serve for shiftably receiving two pressing roll holders 14 for accommodating the upper rolls 1–4. Each upper roll holder 14 is composed of an upper part 15 and a lower part 16. The upper part 15 forms a cylinder unit having a cylinder chamber 17 in which a piston 18 is slidably received. A piston rod (pressure rod) 19 is attached to the piston 18 and is guided in a bore 20 of the upper part 15 and in a bore 21 of the lower part 16. The stub shaft 1*a* of the upper roll 1 projects through an opening of a holding plate 24*a* and is received in a bearing 22 which extends in a space 23 between the pressing roll holder 14 and the roll stub shaft of the lower roll I.

A diaphragm 25 which is in engagement with the face of the piston 18 divides the cylinder chamber 17 into an upper work chamber 17*a* and a lower work chamber 17*b* which may be selectively vented or charged with compressed air.

In operation, after a sliver bundle 5 has been positioned over the lower rolls I, II and III, the pressing arms 11 are pivoted inwardly (downwardly) into the working position illustrated in FIG. 1 and immobilized therein so that the upper rolls 1, 2, 3 and 4 may press the sliver bundle 5 against the lower rolls I, II and III. Such a pressing force is exerted by the weight of the pressure rods on the bearings 22 and by the pressurization of the upper work chamber 17*a* of each pressing device 6–9. As a result, the respective pressure rod 19—displaceable in the direction of the arrows D and E—presses down on the associated bearing 22 to generate the earlier noted pressure between the upper roll 1 and the lower roll I.

A carrier element formed as a slide pin 26 is mounted at an angle of 90° to the pressing rod 19 by a securing screw 28 and is shiftable in the direction of the arrows F and G relative to the pressing rod 19 by virtue of a slot 27 which is provided in the slide pin 26 and through which the securing screw 28 extends. The slide pin 26 is, at one end, supported in a bearing housing 29 which is shiftable in the direction of the arrows H, I and in which a non-illustrated driving device is accommodated for shifting the slide pin 26. The holding plate 24*a* has a throughgoing opening 30 in alignment with the slide pin 26. By shifting the slide pin 26 in the direction of the arrow G, it may form-fittingly project through the opening 30.

Figure 3A:
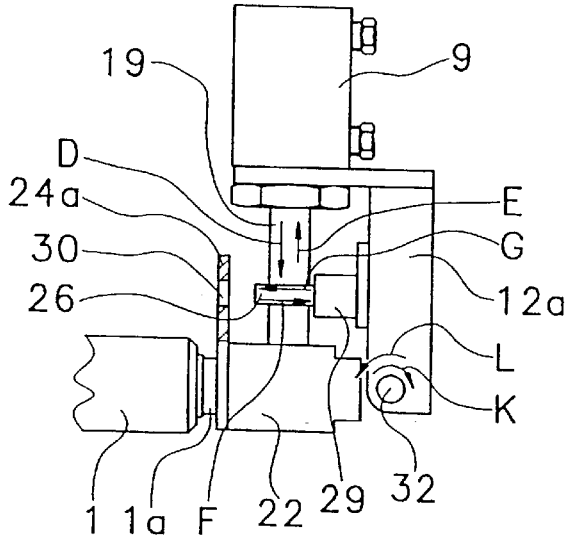
FIG. 3*a* is a front elevational view illustrating the device according to the invention, showing a downwardly pivoted pressing arm and a carrier element illustrated out of engagement with the upper roll.
Figure 3B:
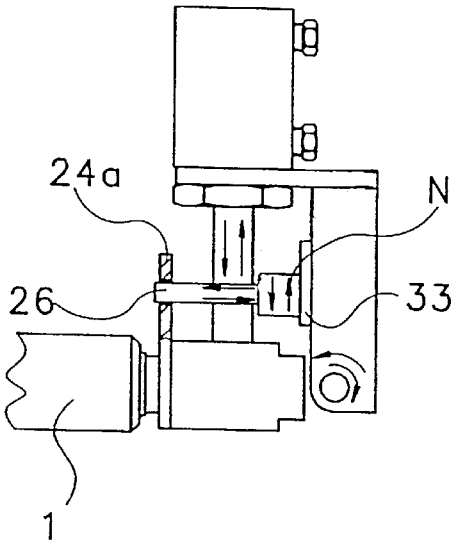
FIG. 3*b* is a view similar to FIG. 3*a* showing the pressing arm in an inwardly pivoted position, while the carrier element is in an engaged state and the upper roll is in a lowered position.
Figure 3C:
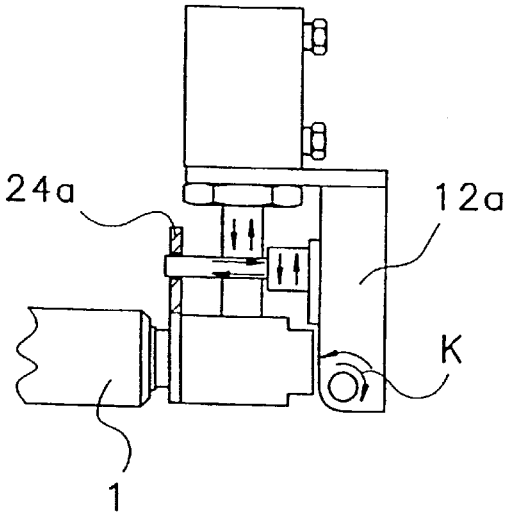
FIG. 3*c* is a view similar to FIG. 3*a* showing the pressing arm in an inwardly pivoted position, while the carrier element is in an engaged state and the upper roll is in a raised position.

In FIG. 3*a* the pressing arm 12*a* is shown in an inwardly pivoted, upright state, and the pressing rod 19 of the pneumatic pressing device 9 presses on the bearing 22. The slide pin 26 is out of engagement with the holding plate 24*a*. The pressing arm 12*a* is rotatable in the direction of the arrows K, L about a rotary bearing 32 which is supported by the machine frame 35. According to FIG. 3*b* the slide pin 26 has been shifted in the direction of the arrow G and thus extends into the holding plate 24*a* through the aperture 30. Thereafter the pressing rod 19 is shifted upwardly in the direction of the arrow E. Also referring to FIGS. 2*a* and 2*b*, since the slide pin 26 is connected to the pressing rod 19 by means of the screw 28 (see FIGS. 2*a* and 2*b*), the holding plate 24*a*, together with the upper roll 1 is also lifted in the direction E to the same extent as the pressing rod 19, as illustrated in FIG. 3*c*. At the same time, the attachment $\mathbf{22}_1$ of the bearing 22 is lifted out of the supporting extension 13*a* of the stand 13. Also at the same time, the housing 29 too, which is shiftably supported by a slide bearing 33 at the pressing arm 11*a*, is displaced in the direction of the arrow N through the same extent as the pressing rod 19. As a result, the upper roll 1 is relieved of pressure. Subsequently, since the slide pin 26 is in a form-locking relationship with the holding plate 24*a*, the upper roll 1 is also shifted further in the direction N and is thus lifted off the lower roll.

Figure 4A:
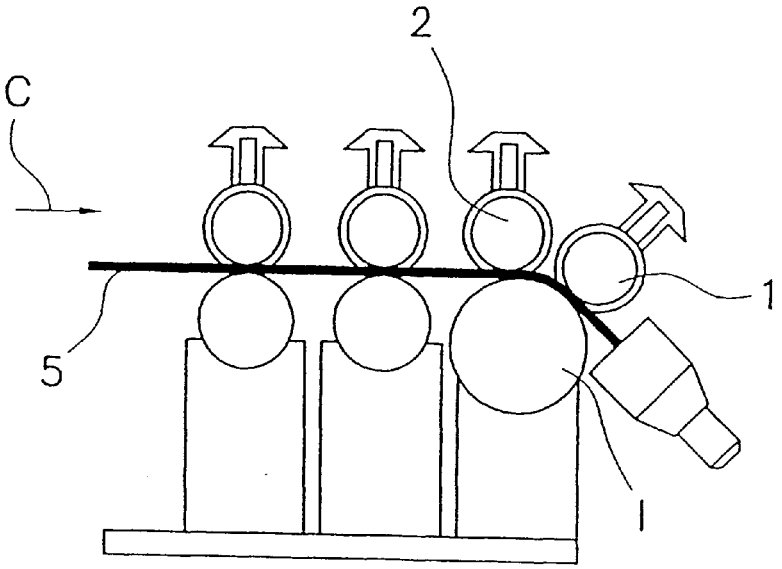
FIG. 4*a* is a side elevational view of the drawing unit shown in operation with loaded upper rolls.

As shown in FIG. 4*a*, the upper output rolls 1 and 2 lie, in operation, with pressure on the lower output roll I and the fiber material 5 runs between the upper output rolls 1 and 2 and the lower output roll I. In case of an extended disturbance—which is detected by the non-illustrated electronic control and regulating device for the roll drive motors—the upper output roll 1 is relieved of pressure and is immediately lifted off the fiber material 5, that is, it is lifted off the lower output roll 1 by a distance a. This occurrence prevents the fiber material from sticking to the upper output roll 1 since no pressure prevails which forces any sticking substance of the fiber material 5 against the upper output roll 1. By virtue of the fact that the upper output roll 2 is relieved of the additional external pressure, but remains in place by gravity, the fiber material 5 remains firmly clamped between the upper output roll 2 and the lower output roll I and may, upon restart, be guided without difficulty by the upper output roll 1 and the lower output roll I.

Figure 5:
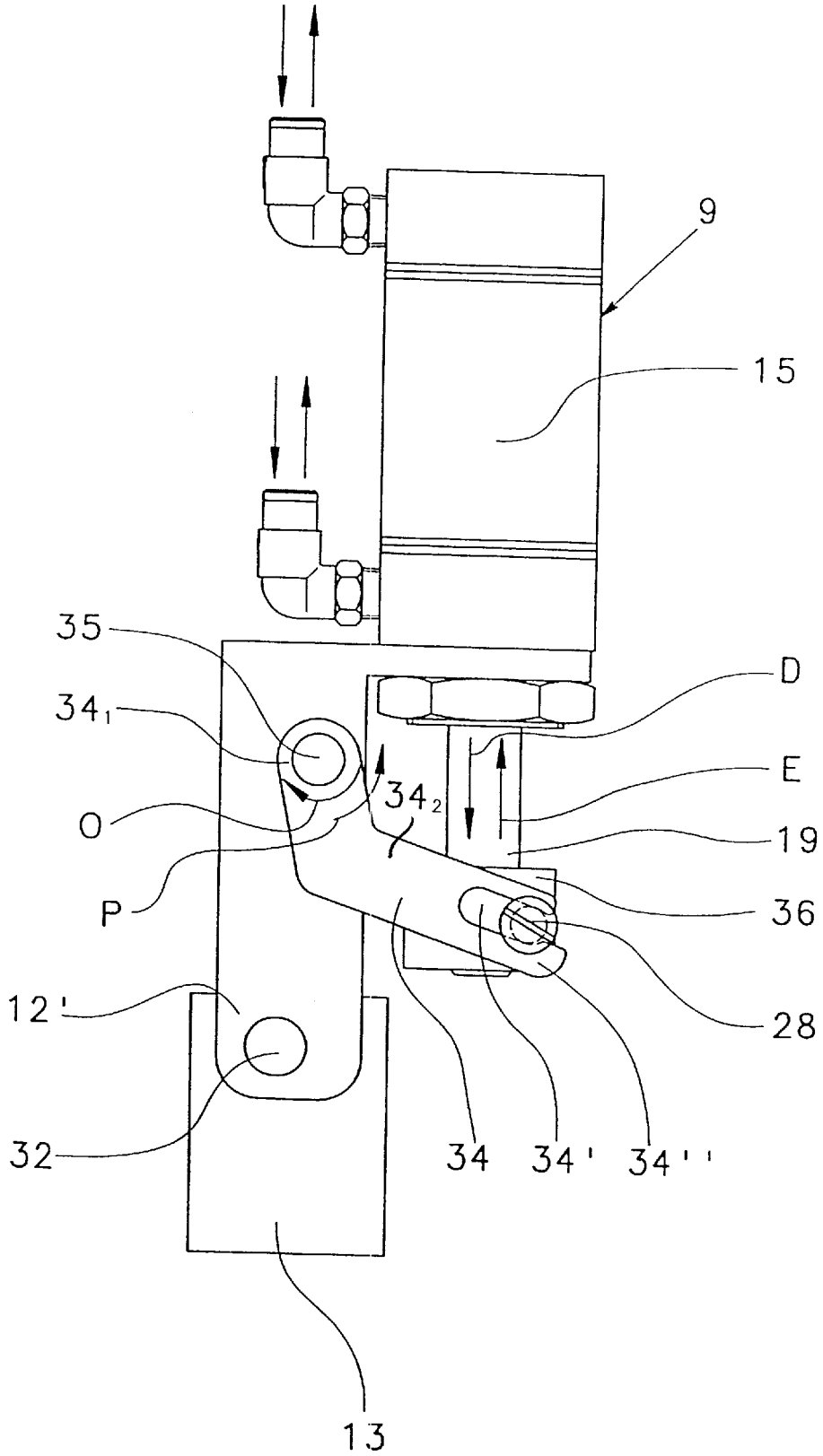
FIG. 5 is a front elevational view showing details of one part of a preferred embodiment of the invention.

Turning now to FIG. 5, the lever 34 constituting a carrier element is at one end $\mathbf{34}_1$ rotatably jointed for pivotal motions in the direction of the arrows O, P to a rotary bearing 35 which is secured to the lateral column 12' of the pressing arm 12. The lever 34 is a single lever crank, whose two arms are oriented at an obtuse angle to one another. The other end $\mathbf{34}_2$ of the lever 34 terminates in a fork 34' through which extends a pin 28 secured to an intermediate element 36 which, in turn, is mounted on the pressing rod 19. One tine of the fork 34' has a carrier attachment (carrier element) 34" which may project into the opening 30 of the holding plate 24*a* (not shown in FIG. 5). If the pressing rod 19 is shifted in the direction of the arrow E, the carrier element 34 pivots about the bearing 35 in the direction P and the carrier attachment 34" is shifted in the direction E in a circular path about the center of the bearing 35. At the same time the lever 34 rotates in the direction of the arrow P and the opening 34' moves in the direction of the pin 28 so that the carrier attachment 34" projects beyond the pin 28 as the latter slides inwardly into the fork 34'. In this manner, the carrier attachment 34" is placed in a position in which it may project into the opening of the non-illustrated holding plate for the upper roll 1 (also not shown in FIG. 5). If the pressing rod 19 is shifted in the direction of the arrow D, all motions occur in the opposite direction.

Figure 6A:
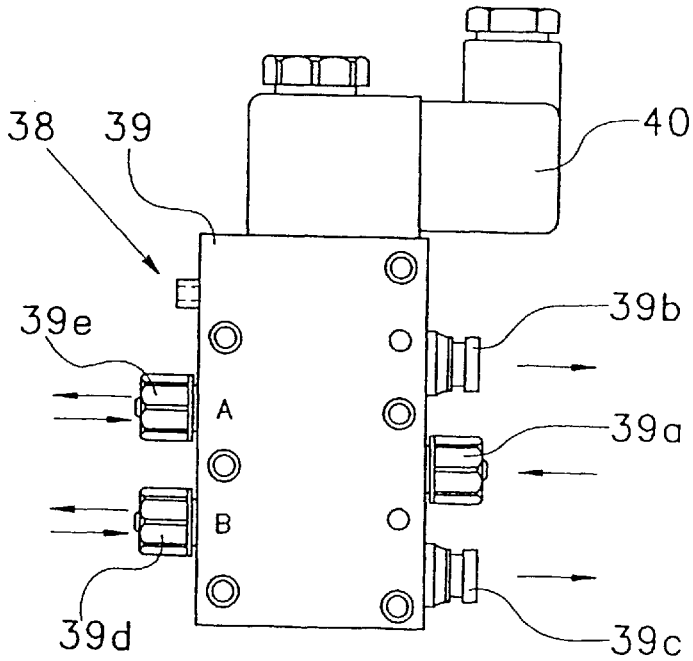
FIG. 6*a* is a schematic side elevational view of a pneumatic 5/2-way valve forming part of the structure according to the invention.
Figure 6B:
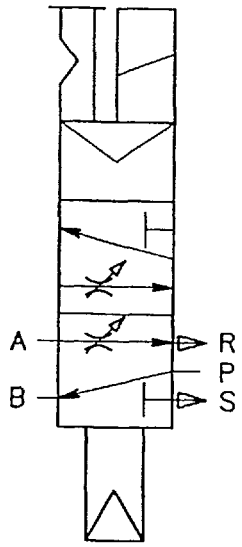
FIG. 6*b* is a symbolic representation of the pneumatic 5/2-way valve shown in FIG. 6*a*.

The pneumatic control of the loading (pressure-applying) device of the drawing unit is effected by means of two 5/2-way valves as shown in FIGS. 6*a* and 6*b*. For loading the upper output roll 1 an own (dedicated), separately controllable 5/2-way valve is provided with which the following three switching states may be obtained:

A. The piston 18 is, in its lower dead center, charged with compressed air, that is, the upper rolls 1–4 are loaded. In this arrangement the loading force for each upper roll 1–4 may be individually regulated by pressure regulators. Further, for safety reasons, the pressure is monitored by pressure switches.

B. The piston 18 is vented, at its lower dead center, that is, the upper roll loading device may be pivoted upwardly without the upper rolls 1–4 since the latter are not fixed to the device, as shown in FIG. 5. Such a state is effected automatically when the machine is at standstill. This arrangement ensures that the coatings provided on the upper rolls as well as the fiber material are not exposed to unnecessary stresses.

Figure 4B:
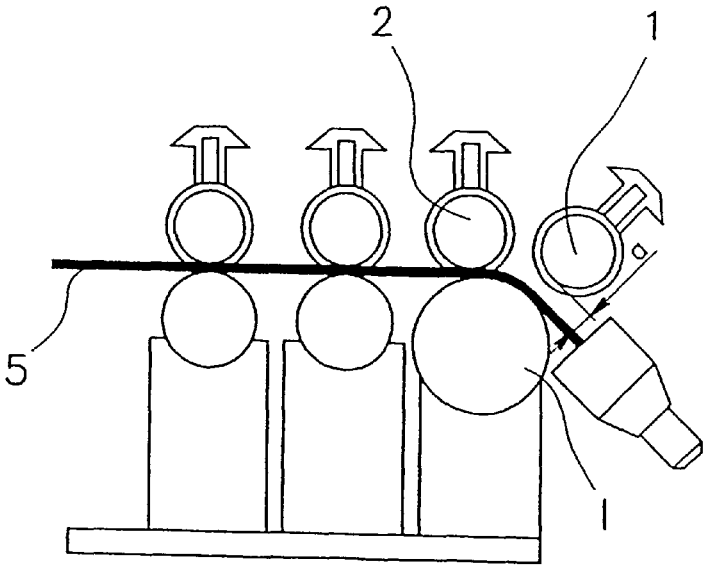
FIG. 4*b* is a side elevational view of the drawing unit shown in an idling state with a raised upper outlet roll (deflecting roll).

C. The piston 18 is, at its upper dead center, charged with pressurized air, that is, the upper roll 1 is raised, as shown in FIG. 4*b*.

Turning to FIG. 6*a,* in the pneumatic valve 38 a solenoid 40 is operating a 5/2-way valve 39 which has a supply air inlet nipple 39*a,* a first venting nipple 39*b,* a second venting nipple 39*c,* a work nipple 39*d* (way 1) and a work nipple 39*e* (way 2). The arrows show the direction of the air flow. FIG. 6*b* is a symbolic representation of the operation of the 5/2-way valve 39. Dependent upon the state and direction of pressurization through the work nipple 39*d* three switching states may be obtained. The additional work nipple 39*e* may be blocked or may be utilized, for example, for a pneumatic control of the slide pin 26 (shown in FIGS. 2*a,* 2*b* and 3*a*–3*c*). The arrows indicate the directions of the air flow.

It is noted that relieving an upper roll 1–4 of pressure according to the invention may be effected automatically after stoppage of the draw frame. For this purpose, for example, a motion sensor may be provided which applies a signal to a timer as the draw frame stops, and the timer, in turn, applies a signal—after a predetermined delay—to actuate the valve 38. Upon restarting the draw frame the motion sensor may apply a signal directly to the valve 38 to effect re-pressurization of the upper roll or rolls.

The invention was described in connection with pneumatic pressure elements as an example. It will be understood that mechanical, hydraulic or electric pressure elements may also be used for loading the upper rolls 1–4.

In practice, in the absence of the invention many loops appear about the deflecting roll 1, particularly because reviving agents and adhesive particles are present in the fiber. As an operational disturbance in the machine occurs, such as sliver rupture, coiler can replacement or the like, frequently the machine attendants are not capable of immediately eliminating such disturbances. The drawing unit is relieved of pressure after a malfunction appears, but the hot deflecting roll 1 continues to lie on the fibers 5 by gravity. In case such a state persists for an extended period, the sticky fibers 5 are glued to the deflecting roll 1 and upon machine restart, the sticky fibers 5 are wound about the deflecting roll 1. According to the invention, it is feasible to lift the deflecting roll 1 by means of a separate valve upon occurrence of a disturbance. By lifting the deflecting roll 1 the fibers 5 cannot stick to the roll and the pressure on the lower roll I is reduced whereby the tendency of looping (winding of fiber about the roll) significantly diminishes. Such a reduction in the looping tendency significantly increases the efficiency of the drawing frame in case sticky fibers are processed because the delays involved with operational disturbances and their elimination are substantially reduced or avoided.

It will be understood that the above description of the present invention is susceptible to various modifications, changes and adaptations, and the same are intended to be comprehended within the meaning and range of equivalents of the appended claims.

What is claimed is:

1. A method of operating a draw frame including a plurality of serially arranged roll pairs each defining a nip through which a fiber sliver passes from roll pair to roll pair; each roll pair being formed of an upper roll and a lower roll; one of the roll pairs being an output roll pair having an upper output roll and a lower output roll;

a pressing arm carrying the upper rolls;

pressing devices accommodated in the pressing arm for pressing each upper roll against a respective lower roll;

the method comprising the following steps:

(a) during a working state of the draw frame, passing the sliver consecutively through the roll pair nips while the pressing devices press the upper rolls against respective lower rolls; and (b) during an interruption of the working state relieving solely said upper output roll of pressing forces to an extent that at the most only an insubstantial pressure is exerted by said upper output roll on the sliver situated in the nip between the upper output roll and the lower output roll.

2. The method as defined in claim 1, wherein step (b) is performed automatically after said interruption.

3. The method as defined in claim 1, further comprising the step of automatically loading said upper output roll after resumption of said working state.

4. The method as defined in claim 1, wherein step (b) comprises the step of lifting said upper output roll off said lower output roll.

5. The method as defined in claim 4, wherein the lifting step comprises the step of lifting said upper output roll for obtaining a clearance from the sliver situated in the nip of the output roll pair.

6. The method as defined in claim 1, wherein said upper output roll is a first upper output roll and wherein said lower output roll cooperates with a second upper output roll; further wherein step (b) comprises the step of relieving solely said first and second upper output rolls of pressing forces.

7. A draw frame comprising (a) a plurality of serially arranged roll pairs each defining a nip through which a fiber sliver passes from roll pair to roll pair; each roll pair being formed of an upper roll and a lower roll; one of the roll pairs being an output roll pair having an upper output roll and a lower output roll;

(b) a pressing arm carrying the upper rolls;

(c) pressing devices accommodated in the pressing arm for pressing each upper roll against a respective lower roll; each pressing device having a pneumatic cylinder;

(d) first charging means for supplying the pneumatic cylinders with pressure to press the upper rolls against respective lower rolls;

(e) second charging means for supplying the pneumatic cylinder associated with said upper output roll with pressure to lift the upper output roll off the lower output roll; and (f) a dedicated, controllable valve coupled to the pneumatic cylinder associated with said upper output roll and serving solely said upper output roll; said valve forming part of said first and second charging means.

8. The draw frame as defined in claim 7, wherein said upper output roll is a first upper output roll; further comprising a second upper output roll cooperating with said lower output roll; and further wherein said dedicated, controllable valve is associated solely with said first and second upper output rolls.

* * * * *